US005827339A

United States Patent [19]

Nagafune et al.

[11] Patent Number: 5,827,339

[45] Date of Patent: Oct. 27, 1998

[54] APPARATUS FOR GENERATING CHEMICAL-FREE DRY AIR

[75] Inventors: Hitoshi Nagafune; Takaaki Fukumoto; Hakushi Shibuya; Koji Ezaki, all of Tokyo, Japan

[73] Assignee: Mitsubishi Denki Kabushiki Kaisha, Toyko, Japan

[21] Appl. No.: 829,954

[22] Filed: Apr. 1, 1997

[30] Foreign Application Priority Data

Oct. 1, 1996 [JP] Japan ..... 8-260448

[51] Int. Cl.[6] ..... B01D 46/00

[52] U.S. Cl. ..... 55/350.1; 55/385.2; 55/417; 55/471; 55/486

[58] Field of Search ..... 55/482, 486, 471, 55/342, 473, 385.2, 417, 350.1

[56] References Cited

U.S. PATENT DOCUMENTS

| | | | |
|---|---|---|---|
| 3,192,689 | 7/1965 | Smith | 55/342 |
| 3,299,620 | 1/1967 | Hollingsworth | 55/486 |
| 4,601,737 | 7/1986 | Gherbig | 55/493 |
| 4,629,479 | 12/1986 | Cantoni | 55/471 |
| 4,986,838 | 1/1991 | Johnsgard | 55/223 |
| 5,064,547 | 11/1991 | Weber | 55/467 |
| 5,626,820 | 5/1997 | Kinkead et al. | 422/122 |

*Primary Examiner*—Jay H. Woo
*Assistant Examiner*—Robert Hopkins
*Attorney, Agent, or Firm*—Oblon, Spivak, McClelland, Maier & Neustadt, P.C.

[57] ABSTRACT

A clean dry air generating unit that includes a fan filter unit and a dry air generating apparatus arranged within a chamber of closed construction. The fan filter unit includes an open air introducing fan, a chemical filter, and a HEPA filter. The chamber of closed construction is supplied air through the fan filter unit which is then supplied to the dry air generating apparatus. Clean dry air is fed from the generating unit to an area outside of the chamber or can be reintroduced to the generating unit. The apparatus can continuously supply clean dry air at a lower cost.

9 Claims, 3 Drawing Sheets

APPARATUS FOR GENERATING CHEMICAL-FREE DRY AIR

BACKGROUND OF THE INVENTION

The present invention relates to an apparatus for generating chemical-free dry air to be supplied for prevention of chemical pollution in manufacturing, for example, semiconductor devices.

Conventionally, semiconductor devices are manufactured under good surroundings where temperature and humidity are controlled and foreign materials having a size of normally few microns level are removed, because the product yields are reduced due to pollution from the environment during the manufacturing process. Further, dry air is fed when necessary to prevent chemical changes with moisture of the air.

In recent years, with the refining of patterns and the thinning of film due to higher integration of the semiconductor devices, there has arisen a problem of chemical pollution by mists or gases of submicron level composed of organic or inorganic material included in dry air to be supplied to a manufacturing unit, a carrier unit and a storage unit of the semiconductor devices. For example, sulfide system gas, acid system gas or the like mixed in the open air to be taken into the dry air generating apparatus corrodes metals used in the semiconductor devices, thereby lowering the reliability of the semiconductor devices. Thus, there has been employed a method of supplying $N_2$ free from mists and gases to the carrier unit. However, $N_2$ has problems that cost is higher (about 35 yen/$m^3$) and oxygen deficiency is caused to lower safety. For this reason, it is proposed to supply chemical-free dry air instead of $N_2$.

FIG. 3 is a schematic view showing the conventional apparatus for generating chemical-free dry air. Referring to the drawing, a dry air generating apparatus 6 comprises a compressor 7, a refrigerating type drier 8 and a moisture absorbing catalyst 9. Reference numeral 13 is a chemical absorbing catalyst such as active carbon. Reference numeral 5 is a HEPA (High Efficiency Particulate Air) filter for removing the foreign materials of few microns level. The clean, chemical-free dry air is supplied to the use point such as manufacturing unit, carrier unit, and storage unit by removing moisture from the introduced open air by the dry air generating apparatus and thereafter removing chemical mists and foreign materials.

The conventional chemical-free dry air generating apparatus of above described construction had problems that the chemical absorbing catalyst 13 to remove the chemical mists was much higher in cost (costing about 500 million yen for supplying 15000 $m^3$/h) and the like.

An object of the present invention is to provide an apparatus for generating chemical-free dry air, capable of supplying chemical-free dry air at a lower cost.

SUMMARY OF THE INVENTION

In accordance with the present invention, there is provided an apparatus for generating chemical-free dry air comprising a fan filter unit with an open air introducing fan, a chemical filter and a HEPA filter; a chamber of closed construction to which air passed through the fan filter unit is supplied; and a dry air generating apparatus arranged within the chamber of the closed construction, for supplying the dry air to outside of the chamber, with air in the chamber being supplied to the dry air generating apparatus.

The air pressure of the chamber of the closed construction is preferably adjusted so as to become more positive in pressure than the outside of the chamber.

Also, the wall materials of the chamber of the closed construction are preferably coated with a material less in degassing.

Further, the chamber of the closed construction is preferably designed to remove foreign materials and chemical mists from the air within the chamber to purify the air.

Also, plural chambers of the closed construction are arranged in parallel and are connected to a common portion through valves.

DETAILED DESCRIPTION

An apparatus for generating chemical-free dry air according to an embodiment of the present invention will be described hereinafter based on the drawings.

Figure 1:
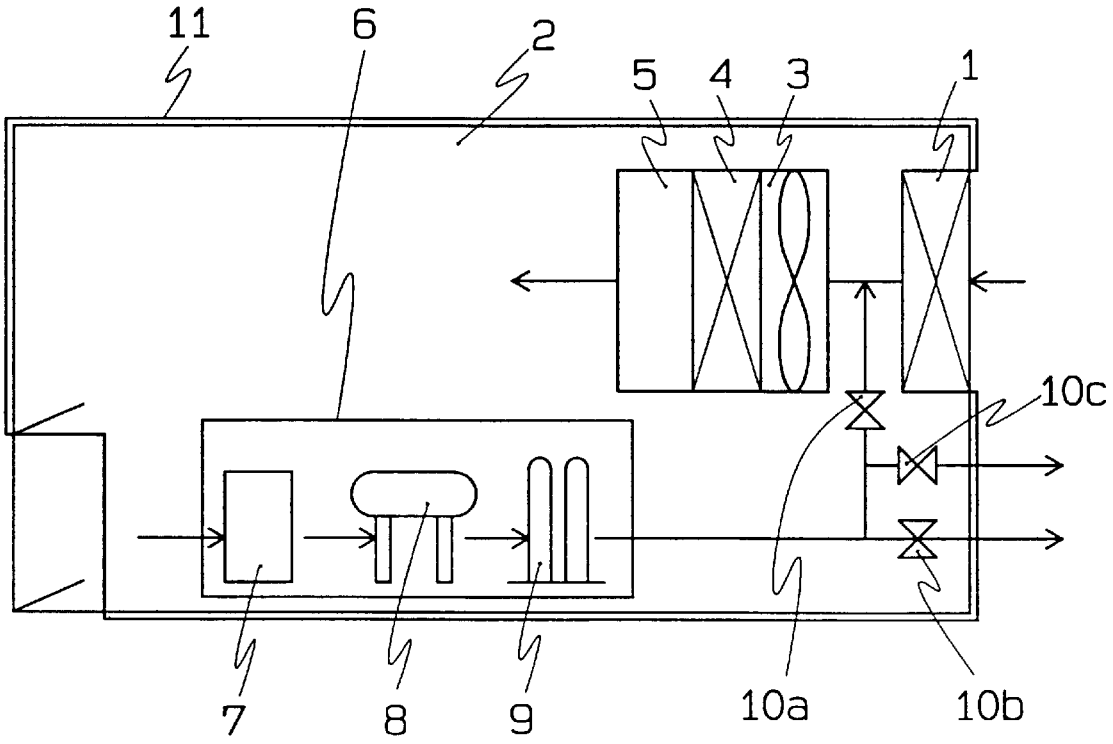
FIG. 1 is a schematic view showing an embodiment of an apparatus for generating chemical-free dry air of the present invention.

FIG. 1 is a schematic view showing an apparatus for generating chemical-free dry air of the present invention. Referring to the drawing, reference numeral 1 is a primary filter arranged in an open air introducing portion, and reference numeral 2 is a fan filter unit comprising a fan 3 for introducing open air, a chemical filter 4 and a HEPA filter 5. The fan filter unit 2 takes in the open air through the primary filter 1 to supply clean, chemical-free air free from chemical mists and foreign materials of few microns level through the chemical filter 4 and the HEPA filter 5.

A dry air generating apparatus 6 comprises a compressor 7, a refrigerating type drier 8 and a moisture absorbing catalyst 9. Valves 10*a*, 10*b* and 10*c* are provided in a piping. The valve 10*a* opens and closes flow of the air from the dry air generating apparatus 6 to the fan filter unit 2. The valve 10*b* opens and closes flow of the air from the dry air generating apparatus 6 to the use point. The valve 10*c* opens and closes exhaust air, to the outside of the generating apparatus, of the air supplied from the dry air generating apparatus 6. A chamber 11 has a fan filter unit 2, a dry air generating apparatus 6 and the like disposed therein. The entire chamber 11 provides a system for generating the chemical-free dry air. The entrance and exit of the chamber have double doors and the inside of the chamber 11 is controlled in a positive condition higher than the open air so as to prevent the open air from entering into the chamber 11. Also, the inside walls of the chamber 11 are coated with vinyl chloride sheet or the like less in degassing so as to prevent the degassing from the concrete.

At first, the system for generating chemical-free dry air operates a fan 3 for introducing the open air to take in the open air through the primary filter 1, and supplys into the chamber 11 a clean, chemical-free air which is free from chemical mists and foreign materials of few microns level through the chemical filter 4 and the HEPA filer 5. Then, the compressor 7 is operated to introduce into the dry air generating apparatus 6 the clean, chemical-free air supplied into the chamber 11 so as to supply the chemical-free dry air of which moisture is removed through the refrigerating type drier 8 and the moisture absorbing catalyst 9, to the use points such as manufacturing unit and carrier apparatus through the piping and the valve 10*b*. The absorbing efficiency of the chemical mists becomes worse due to the reduction in reaction under high pressures, because the chemical filter 4 removes the chemical mists through the chemical reaction, although the air velocity in the piping for supplying the chemical-free dry air to the use points requires approximately 10 m/s. A chamber approximately the same in size as the chamber 11 is required at the later stage of the chemical filter 4, because it is necessary to allow the air to pass through the chemical filter 4 at a velocity of about 1 m/s to maintain the absorbing efficiency of the chemical mists.

When the inside of the chamber 11 has been polluted with foreign materials and chemical mists due to maintenances of the fan filter unit 2, the dry air generating apparatus 6 and the like, or unexpected accidents, the inside of the chamber 11 is purified by closing the valve 10*b* from the dry air generating apparatus 6 to the use point and by opening the valve 10*a* to the fan filter unit 2 to allow the air supplied from the dry air generating apparatus 6 to pass through the chemical filter 4 and the HEPA filter 5 again, and by repeatedly circulating the air from the value 10*a* to the chemical filter 4 and the HEPA filter 5 until the foreign materials and chemical mists within the chamber 11 are completely removed. Alternatively, the valve 10*a* and the valve 10*b* are closed and the valve 10*c* is opened to exhaust the polluted air to the outside of the chamber 11.

Figure 3:
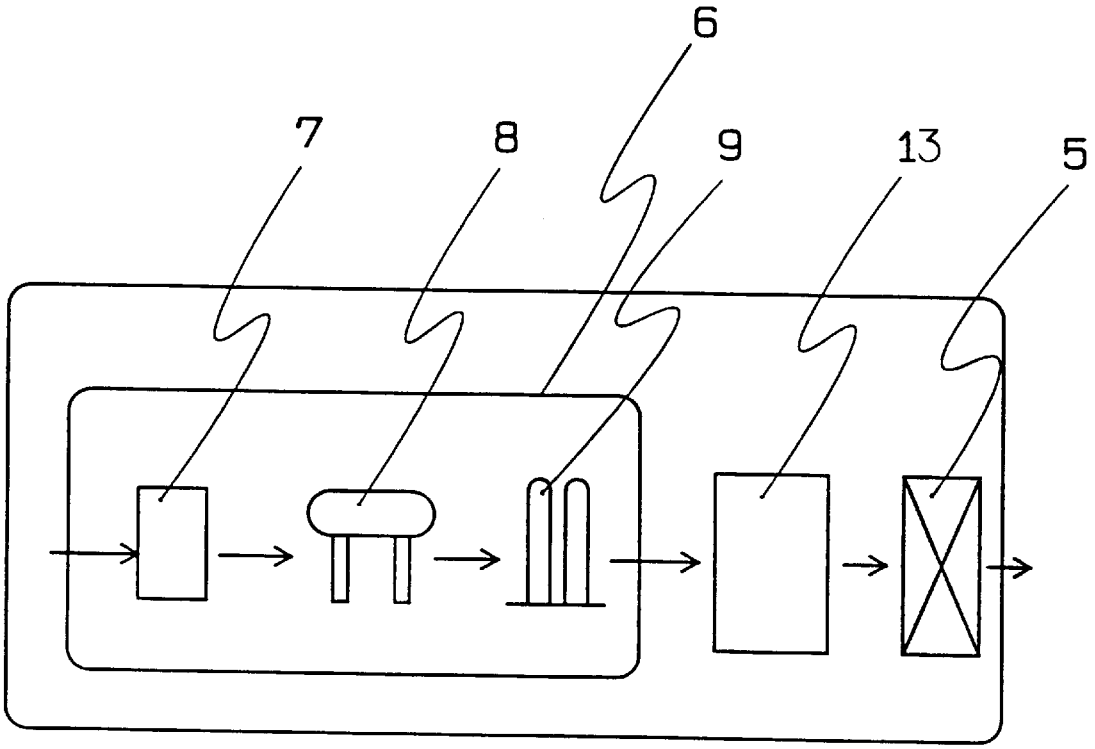
FIG. 3 PRIOR ART
FIG. 3 is a schematic view showing the conventional apparatus of this type for generating chemical-free dry air.

The present invention can supply at a lower cost the chemical-free dry air, with the use of the chemical filter 4 lower in cost as compared with the chemical absorbing catalyst 13 shown in FIG. 3, without reduction in absorption efficiency in the chemical mists.

Figure 2:
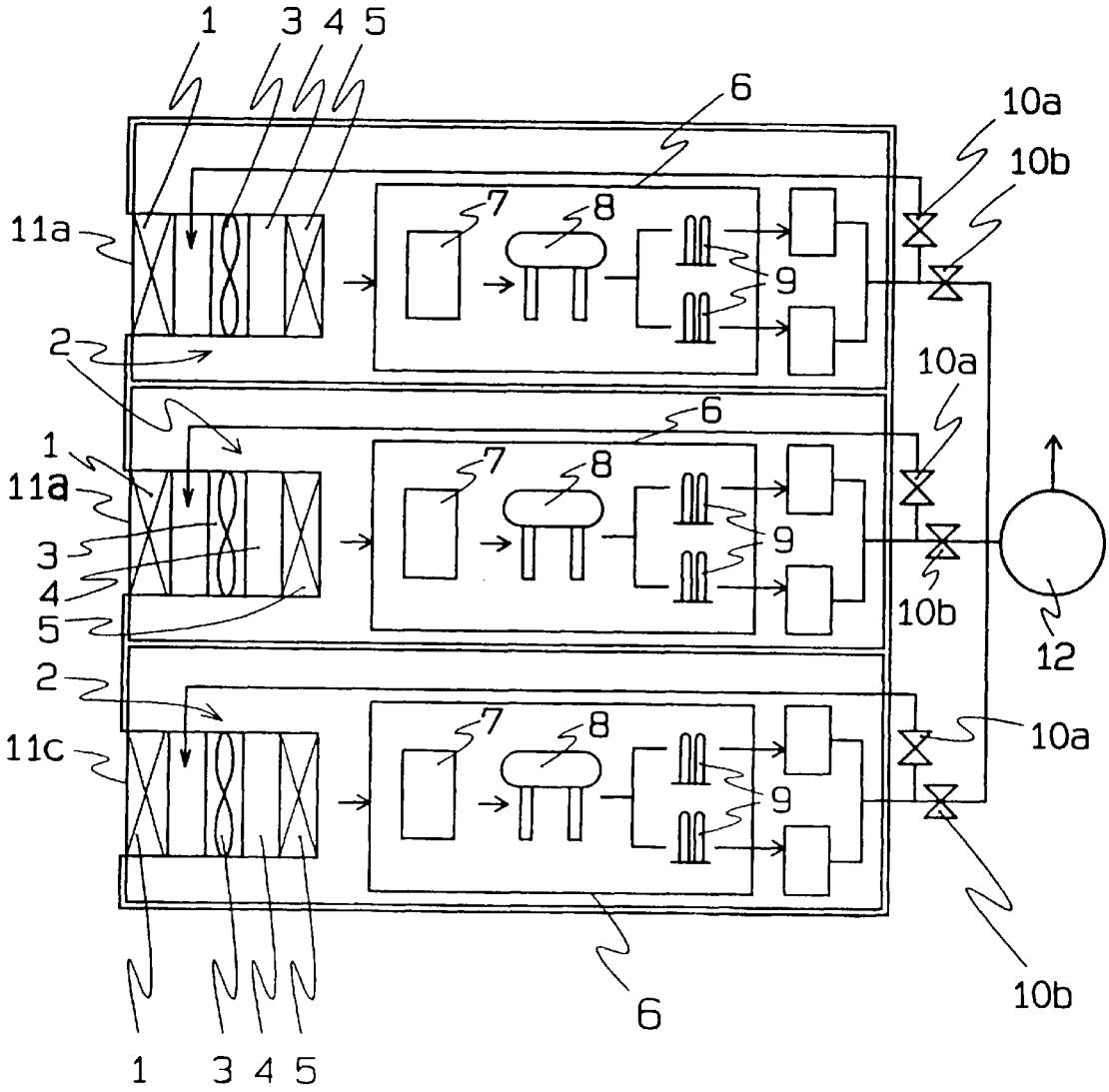
FIG. 2 is a schematic view showing another embodiment of an apparatus for generating chemical-free dry air of the present invention.

FIG. 2 is a schematic view of an another embodiment of an apparatus for generating chemical-free dry air of the present invention, where a plurality of apparatuses for generating the chemical-free dry air shown in the above embodiment are arranged in parallel. Referring to the drawing, chambers 11*a*, 11*b* and 11*c* each have a system for generating the chemical-free dry air independently and are connected with a receiver tank 12 through the piping and the valves 10*b* to supply the chemical-free dry air to the use point via receiver tank 12. The construction within each chamber 11*a*, 11*b* and 11*c* is the same as that of the apparatus for generating the chemical-free dry air shown in the above embodiment, so that the description thereof is omitted.

The moisture absorbing catalyst 9, the chemical filter 4, the HEPA filter 5 and the like require maintenance frequently. When carrying out maintenance of one of the chambers, the chemical-free dry air can be continuously supplied from the other chambers (11*b* and 11*c*) which are not subject to maintenance to the use point by carrying out maintainance with closing only the valve 10*b* of the chamber (for example, 11*a*) to be subject to maintenance.

According to the present embodiment, the chemical-free dry air can be continuously supplied to the use point by merely opening and closing the valve 10*b*, in the case of regular maintenance of each apparatus and unexpected accidents, by the parallel arrangement of the chambers 11*a*, 11*b* and 11*c* each having an independent chemical-free dry air generating system.

As described above, the present invention can continuously supply the chemical-free dry air at a lower cost.

What is claimed is:

1. An apparatus for generating clean dry air, having at least one unit comprising:

a fan filter unit having, an open air introducing fan, a chemical filter disposed downstream of said open air introducing fan to remove chemical mists from air introduced by said open air introducing fan, and a HEPA filter disposed downstream of said open air introducing fan to remove particulate matter of a predetermined micron level from air introduced by said open air introducing fan;

a chamber of closed construction having an entrance at which the fan filter unit is located and to which air passed through the fan filter unit to remove chemical mists and particulate matter is supplied; and a dry air generating apparatus arranged within the chamber of closed construction downstream of said fan filter unit, for generating dry air from the air supplied to the chamber of closed construction and providing said dry air to outside of the chamber.

2. The apparatus of claim 1, wherein said air supplied by said fan filter unit to the chamber of closed construction is adjusted so as to become more positive in pressure than the outside of the chamber.

3. The apparatus of claim 1, wherein wall materials of the chamber of closed construction are coated with a material exhibiting a predetermined amount of degassing.

4. The apparatus of claim 2, wherein wall materials of the chamber of closed construction are coated with a material exhibiting a predetermined amount of degassing.

5. The apparatus of claim 1, further comprising:

exit piping connecting said dry air generating apparatus to an exterior of said apparatus for generating clean dry air;

recirculation piping connected to said exit piping and said fan filter unit;

a recirculation valve, located in said recirculating piping, to control flow of air from said exit piping to said fan filter unit;

a shutoff valve, located in said exit piping between said recirculation piping and said exterior, for shutting off flow of air-from said exit piping to said exterior;

wherein the chamber of closed construction is designed to remove foreign materials and chemical mists from the air within the chamber to purify the air.

6. The apparatus of claim 2, further comprising:

exit piping connecting said dry air generating apparatus to an exterior of said apparatus for generating clean dry air;

recirculation piping connected to said exit piping and said fan filter unit;

a recirculation valve, located in said recirculating piping, to control flow of air from said exit piping to said fan filter unit;

a shutoff valve, located in said exit piping between said recirculation piping and said exterior, for shutting off flow of air from said exit piping to said exterior;

wherein the chamber of closed construction is designed to remove foreign materials and chemical mists from the air within the chamber to purify the air.

7. The apparatus of claim 1, wherein plural chambers of closed construction are arranged in parallel and are connected to a common portion through values.

8. The apparatus of claim 2, wherein plural chambers of closed construction are arranged in parallel and are connected to a common portion through values.

9. An apparatus for generating clean dry air comprising plural of said units as claimed in claim 1, each said unit connected and providing clean dry air to a common portion, wherein:

each of said plural units includes a shut-off valve for shutting off flow of clean dry air from a respective of said plural apparatus to said common portion; and each of said plural units includes a diversion valve for diverting flow of clean dry air produced by said respective apparatus to the open air introducing fan of said respective apparatus to introduce clean dry air thereto.

* * * * *